United States Patent [19]

Holland

[11] 4,371,352

[45] Feb. 1, 1983

[54] WATER SKI TOW HANDLE

[76] Inventor: Dennis P. Holland, 3599 Orchard Lake Rd., Orchard Lake, Mich. 48033

[21] Appl. No.: 225,025

[22] Filed: Jan. 14, 1981

[51] Int. Cl.[3] ..... A63C 5/00; A63C 9/00; A63C 11/00; A63C 15/00

[52] U.S. Cl. ..... 441/69; 264/279.1

[58] Field of Search ..... 264/279.1, 275, 318, 264/279; 16/110 R, 111 R, 111 A, 112; 9/310 R, 310 A; 272/61, 143; 441/69

[56] References Cited

U.S. PATENT DOCUMENTS

| | | | |
|---|---|---|---|
| 3,092,068 | 6/1963 | Brownson | 9/310 A |
| 3,537,418 | 11/1970 | Brownson | 9/310 A |
| 3,734,049 | 5/1973 | Humbert | 9/310 A |
| 3,926,201 | 12/1975 | Katz | 264/279.1 |
| 3,930,460 | 1/1976 | Beck | 9/310 A |
| 4,043,290 | 8/1977 | Holland | 9/310 A |
| 4,060,049 | 11/1977 | Rumbaugh | 9/310 A |
| 4,210,478 | 7/1980 | Shoney | 264/275 |

*Primary Examiner*—Trygve M. Blix
*Assistant Examiner*—D. W. Keen
*Attorney, Agent, or Firm*—Gifford, VanOphem, Sheridan & Sprinkle

[57] ABSTRACT

A water ski tow handle having a unique core bar construction is provided and comprises an elongated tubular and cylindrical core bar constructed of a rigid material. A pair of cylindrical plugs having an outside diameter slightly greater than the inside diameter of the core bar are press fit into each end of the core bar so that one end of each plug is flush with its associated end of the core bar. The plugs sealingly engage the inner bore of the core bar and form a flotation chamber within the core bar between the plugs. A transverse hole is formed, preferably by drilling, through each end of the core bar and also through the plug and each transverse bar is dimensioned to receive one prong of a tree bar therethrough. The core bar is then encased with a resilient material, preferably by transfer or injection molding, during which time the tree bar prevents longitudinal displacement of the plugs relative to the core bar.

10 Claims, 6 Drawing Figures

Fig-1
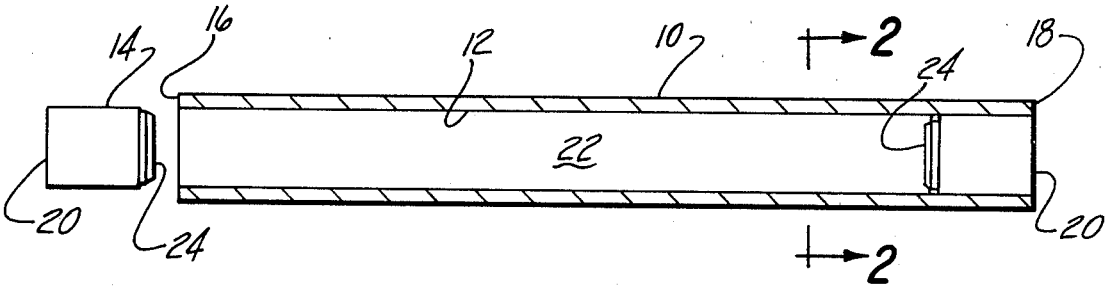
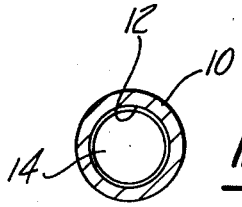
Fig-2
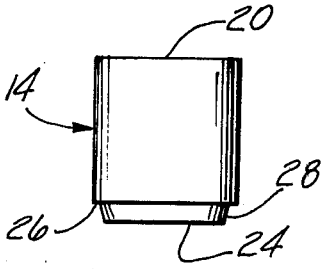
Fig-5
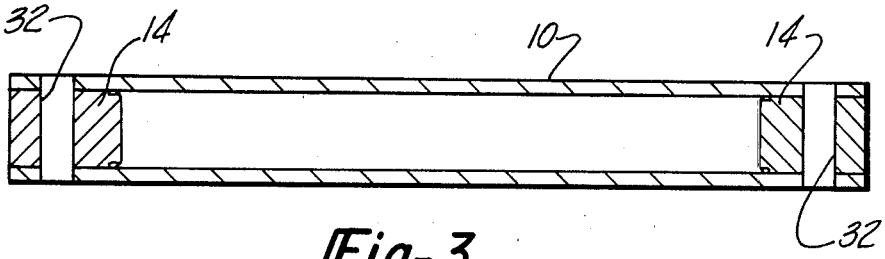
Fig-3
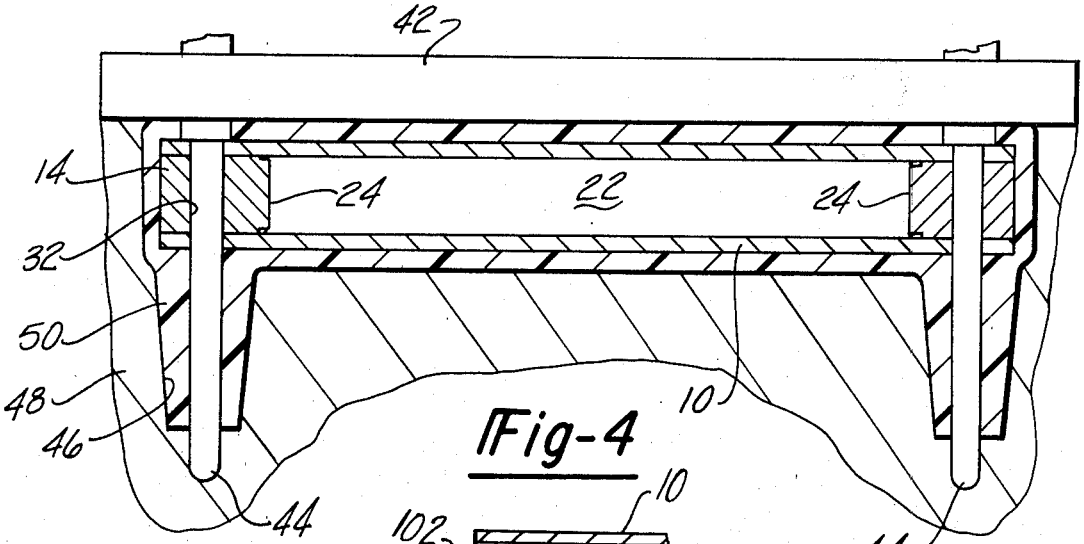
Fig-4
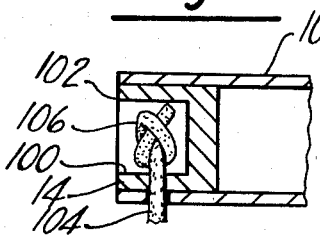
Fig-6

WATER SKI TOW HANDLE

BACKGROUND OF THE INVENTION

I. Field of the Invention

The present invention relates to water ski tow handles.

II. Description of the Prior Art

There are a plurality of previously known water ski tow handles comprising a tubular and cylindrical core bar which is covered or encased by a resilient material. For example, U.S. Pat. No. 3,092,068 to Brownson discloses such a water ski tow handle. In addition, in the Brownson patent, a pair of plugs 12 and 12′ are positioned within the interior of the core bar and form a flotation chamber 26 therebetween for the water ski tow handle. U.S. Pat. No. 3,537,418 to Brownson also discloses a water ski tow handle having a tubular and cylindrical core bar covered by a resilient material and in which a pair of plugs 24 are positioned within the core bar and form a flotation chamber therebetween.

One disadvantage of these previously known water ski tow handles, however, is that the tow line for the handle is attached only to the core bar itself. Since these core bars are conventionally constructed of a relatively thin wall metal, the strength of the tow handle against bending or breakage is necessarily limited to the strength of the core bar. While these previously known water ski tow handles are sufficient for most purposes, such tow handles are inadequate for high speed or competitive water skiing.

A still further disadvantage of these previously known water ski tow handles is that the resilient covering for the core bar cannot be placed over the core bar under high pressure and high temperature conditions such as exist during an injection molding or transfer molding process. Rather, when these previously known water ski tow handles are subjected to injection molding, the pressures present during the injection molding longitudinally displace the plugs within the core bar and squash these plugs together. Simultaneously,the injected material fills the interior of the core bar up to the plugs so that the water ski tow handle no longer floats.

One method attempted by the Applicant to prevent the displacement of the plugs during injection molding is been to create a relatively large interference fit between the plugs and the interior of the core bar and then to press fit these plugs into the core bar. This attempt, however, has proven unsuccessful. It is believed that during the elevated temperatures present during an injection molding process, the core bar expands beyond its yield point or point of elasticity. Consequently, the core bar fails to completely thermally contract upon cooling so that the fluid seal between the plugs and the core bar is lost. Without this fluid seal, the air within the flotation chamber expels past the plugs during the injection molding process thus forming a vacuum within the core bar. As the core bar cools, the vacuum draws the injected or other material within the flotation chamber thus destroying its effectiveness.

Attempts have also been made by Applicant to fill the interior of the core bar with a light weight material, such as foam, in order to achieve the desired flotation for the tow handle. Such attempts, however, have also proven unsuccessful since the high pressures during the injection molding process merely squash the foam together. The use of more rigid materials, such as a wooden dow to prevent this unduly increases the weight of the overall core bar so that it no longer floats.

SUMMARY OF THE PRESENT INVENTION

The present invention provides a water ski tow handle having a unique core bar construction. Preferably, the tow handle is injection or transfer molded and is floatable which overcomes all of the above mentioned disadvantages of the previously known water ski tow handles.

In brief, the water ski tow handle according to the present invention comprises an elongated cylindrical and tubular core constructed of a rigid material, such as aluminum. The tow handle further comprises a pair of cylindrical metal plugs having an outside diameter slightly greater than the inside diameter of the core bar. These plugs are press fit into opposite ends of the core bar so that the outer end of each plug is substantially flush with its associated end of the core bar. In addition, due to the interference fit between the cylindrical plug and the core bar, a fluid seal is formed between each plug and the core bar thus forming a flotation chamber within the core bar between the plug.

Thereafter, a transverse hole is formed, preferably by drilling, through each end of the core bar so that each hole intersects and extends through one of the cylindrical plugs. The drilling of these transverse holes also serves to enhance the fluid seal between the plugs and the core bar around the transverse hole.

Thereafter, one prong of a two-pronged tree bar is positioned through each transverse and the tree bar with its attached core bar is positioned within a mold chamber. In addition, the outside diameter of the tree bar prongs is substantially the same as the diameter of the transverse holes for a reason subsequently described.

The mold chamber is then filled with a pressurized resilient thermosetting material at an elevated temperature which encases the core bar and the portion of the tree bar prongs which extend outwardly from the core bar. During this molding process, however, the fluid seal between the plugs and the core bar prevent any resilient material from entering the flotation chamber. In addition, since the diameter of the tree bar prong is substantially the same of the diameter of the transverse holes, the tree bar holds the cylindrical plugs against any longitudinal movement relative to the core bar during the molding process. After the tow handle has cooled, the tow handle is removed from the tree bar and, ultimately, at least part of a tow line is positioned through the transverse hole in each end of the tow handle. It has been found that since the tow line extends through both the core bar and the cylindrical plugs, the overall strength of the tow handle is greatly enhanced in contrast to the previously known tow handles.

Alternatively, the core bar constructed in the previously described fashion is covered by a resilient sleeve under atmospheric temperature and pressure conditions. The sleeve is secured to the core bar in any conventional fashion, such as glue.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 1 is a longitudinal sectional view illustrating a portion of the water ski tow handle according to the present invention;

FIG. 2 is a sectional view taken substantially along line 2—2 in FIG. 1;

FIG. 3 is a longitudinal sectional view similar to FIG. 1 but illustrating still a further step in the manufacture of the tow handle of the present invention;

FIG. 4 is a longitudinal sectional view of the preferred form of the tow handle of the present invention illustrated during a molding process;

FIG. 5 is a side view illustrating one component of the preferred form of the invention and enlarged for clarity; and FIG. 6 is a fragmentary sectional view illustrating a modification of the invention.

DETAILED DESCRIPTION OF A PREFERRED EMBODIMENT OF THE PRESENT INVENTION

With reference first to FIGS. 1 and 2, the preferred embodiment of the tow handle comprises an elongated tubular and cylindrical core bar 10 constructed of any suitable rigid material, such as aluminum. The core bar 10 includes an axial throughbore 12 of a predetermined diameter. Furthermore, the inner diameter of the throughbore 12 must be constructed with fairly close tolerances and, in practice, it has been found that the core bar 10 can be advantageously constructed from drawn aluminum tubing.

With reference now to FIGS. 1, 2 and 5, a pair of cylindrical metal plugs 14 are provided, each having an outside diameter greater by a predetermined amount than the inside diameter of the core bar 10. The plugs 14 are press fit into the opposite ends 16 and 18 of the core bar 10 so that one end 20 of each plug is substantially flush with its associated end 16 or 18 of the core bar 10 as shown at the right hand side in FIG. 1. With the cylindrical plugs 14 press fit into the core bar in the above described fashion, the plugs 14 form a flotation chamber 22 within the core bar 10 and between the inner ends 24 of the plugs 14.

With reference particularly to FIGS. 5, the inner end 24 of the cylindrical plug 14 is thereshown in exaggerated detail. An inwardly stepped annular surface 25 is formed entirely around the plug 14 adjacent its inner end 24 so that the surface 26 lies in substantially a radial plane with respect to the axis of the plug 14. A tapered surface 28 is then provided on the plug 14 between the inner radial edge of the annular surface 26 and the end 24 of the plug 14.

When the plugs 14 are press fit into the opposite ends 16 and 18 of the core bar 10, it is essential that the axis of the plugs 14 are aligned with the axis of the core bar 10 during the press fitting operation in order to minimize or eliminate possible distortion of the core bar 10. The tapered surface 28 adjacent the inner end 24 of each plug 14 insures that the tapered surface 28 can be inserted into the ends 16 or 18 of the core bar 10 pass any burrs which may be present at the ends of the core bar 10 and so that the annular surface 26 flatly abuts against each end 16 and 18 of the core bar. In this fashion, the annular surface 26 insures that the plug is axially aligned with the core bar 10 at the onset of the press fitting operation.

With reference now to FIG. 3, the core bar 10 is thereshown with the plugs 14 press fit into the opposite ends of the core bar 10 in the above described fashion. A transverse or diametrically extending hole 32 is then formed through each end of the core bar 10 so that each hole 32 intersects one of the plugs 14. Preferably, the hole 32 is formed by drilling which effectively enhances the fluid seal between the plug 14 and the core bar around the transverse hole 32.

In the preferred form of the invention, the core bar is covered with a resilient material by injection or transfer molding as will be shortly described in greater detail. With reference then to FIG. 4, the core bar 10 with its attached and drilled plugs 14 are then positioned over a tree bar 42 having two outwardly extending prongs 44. The prongs 44 each extend through one of the drilled holes 32 and extend outwardly from one side of the core bar 10. The diameter of the tree bar prong 44, moreover, is substantially the same diameter as the drilled hole 32 so that little, if any, clearance space is provided between the tree bar prongs 44 and the transverse holes 32.

The tree bar 42 with the attached core bar 10 is then positioned within a mold chamber 46 of a mold 48, illustrated only partially. The contour of the mold chamber 46, of course, defines the ultimate shape of the water ski tow handle. As shown in FIG. 4, the mold chamber 46 includes a hand protector portion 50 positioned coaxially around the outwardly extending portion of the prong 44 from the core bar 10.

The mold chamber 46 then filled with a molten resilient thermosetting material, such as rubber, under high pressure and at a predetermined elevated temperature as would be present during a transfer or injection molding operation. The molten resilient material fills the mold cavity 46 thus encasing the core bar 10 and the material is then allowed to cool. During the molding process, which can be, for example, either injection or transfer molding, the tree bar prongs 44 not only prevent the injected material from entering into the transverse hole 32 but also serve to hold the plugs against displacement relative to the core bar 10. Without the tree bar prongs 44 holding the plug 14 against longitudinal displacement, the pressure from the molding process would otherwise push the plugs 14 toward the center of the core bar 10.

After the molding process, the tow handle is allowed to cool and then removed from the mold chamber 46 whereupon the tow handle is completed. Ultimately, the tow lines are strung through the transverse holes 32 and it has been found that the plugs 14 add to the overall rigidity of the tow handle. Consequently, the previously bending or breaking of the previously known water ski tow handles is virtually eliminated even under high speed or competition water skiing conditions.

Furthermore, the flotation chamber 22 formed within the core bar 10 between the inner ends 24 of the plugs 14 is of sufficient size to maintain the water ski tow handle afloat despite the relatively heavy weight of the resilient material encasing the core bar 10.

In order to maintain a water tight seal between the cylindrical plugs 14 and the inner bore 12 of the core bar 10, the plugs 14 must be carefully dimensioned to maintain this interference within a relatively small range. If the interference fit is made too small, the plugs 14 would not provide an adequate fluid seal between the core bar 10 and the plugs 14. Conversely, if the interference fit between the plugs 14 and core bar 10 is too great, it has been found that the core bar 10 radially thermally expands during the molding process beyond its yield point or point of elasticity. When this occurs, the subsequent thermal contraction of the core bar 10 is insufficient to return the core bar 10 to its initial dimension. Its this latter case, an inadequate fluid seal is achieved between the plugs 14 and core bar 10.

Although the core bar is encased in the resilient material during a molding process, alternatively the core bar can be covered by a preformed resilient sleeve under normal atmospheric temperature and pressure conditions by sliding the preformed sleeve axially over the core bar. In this case, the sleeve can be secured to the core bar by any conventional fashion, such as glue.

A still further modification of the invention is illustrated in FIG. 6 in which each plug 14 includes an axial recess 100 having its open end 102 facing outwardly from the end of the core bar 10 so that, as before, a flotation chamber is formed between the plugs 14. A transverse hole is formed through the core bar 10 which intersects the recess 100 so that a tow line 104 can extend through the hole and into the recess 100. The tow line 104 is then knotted at 106 to attach the tow line 104 to the core bar 10 and the knot 106 is nested within the recess 102.

From the foregoing, it can be seen that the present invention provides a floatable water ski tow handle which can be injection or transfer molded. Furthermore, the water ski tow handle according to the present invention provides a stronger water ski tow handle than the previously known handles.

Having described my invention, however, many modifications thereto will become apparent to those skilled in the art to which it pertains without deviation from the spirit of the invention as defined by the scope of the appended claims.

I claim:

1. A water ski tow handle comprising:

an elongated tubular cylindrical core bar, a pair of cylindrical plugs, each plug having an outside diameter larger by a predetermined amount than the inside diameter of said core bar, said plugs being press fit into the opposite ends of said core bar so that said plugs sealingly engage the inner bore of the core bar and form a flotation chamber within the core bar, said core bar including a hole formed transversely through each end and wherein each transverse hole extends diametrically through at least a portion of one of said plugs, a resilient covering encasing said core bar, wherein each transverse hole is dimensioned to receive a member therein, and wherein said core bar is encased with said resilient covering at an elevated temperature and under high pressure conditions, said member securing said plugs against movement with respect to said core bar while said core bar is encased with said resilient covering and being subsequently withdrawn therefrom.

2. The invention as defined in claim 1 wherein each plug includes an annular and inwardly extending step formed adjacent its inner end.

3. The invention as defined in claim 2 wherein each plug comprises an inwardly tapered portion extending from the annular step and to the inner end of the plug.

4. The invention as defined in claim 1 wherein said plugs and said core bar are diametrically dimensioned so that the radial expansion of said core resulting from thermal expansion of said core bar and said plugs combined with said predetermined amount is within the elastic limit of said core bar.

5. The invention as defined in claim 1 wherein the outer end of each plug is substantially flush with one end of the core bar.

6. The invention as defined in claim 1 wherein said transverse hole extends entirely diametrically through said core bar and one of said plugs.

7. The invention as defined in claim 1 wherein said plugs each have an axial recess open to the outer end of the core bar and wherein said transverse hole extends through one side of said core bar and intersects said recess.

8. A water ski tow handle comprising:

a tubular and cylindrical core bar, a pair of cylindrical plugs having an outside diameter larger by a predetermined amount than the inside diameter of the core bar, said tow handle being constructed by press fitting said plugs into the opposite ends of said core bar thus forming a flotation chamber within the core bar, forming a transverse hole through each end of the core bar so that each hole extends diametrically through one plug, inserting a prong of a tree bar through each hole, and encasing said core bar with a pressurized, heated, molten and thermosetting material and subsequently withdrawing said tree bar from said core bar.

9. The invention as defined in claim 8 wherein said transverse holes are drilled through said core bar and said plugs.

10. The invention as defined in claim 8 wherein said prongs have a cross sectional shape substantially the same as said transverse holes.

* * * * *

UNITED STATES PATENT AND TRADEMARK OFFICE

CERTIFICATE OF CORRECTION

PATENT NO. : 4,371,352

DATED : February 1, 1983

INVENTOR(S) : Dennis P. Holland

It is certified that error appears in the above—identified patent and that said Letters Patent is hereby corrected as shown below:

Column 1, line 47, delete "is" and insert --has--.

Column 2, line 13, after "core" insert --bar--.

Column 3, line 58, delete "pass" and insert --past--.

Column 4, line 27, before "then" insert --is--.

Column 5, line 2, delete "Its" and insert --In--.

Signed and Sealed this

*Thirty-first* Day of *May 1983*

[SEAL]

*Attest:*

DONALD J. QUIGG

*Attesting Officer* *Acting Commissioner of Patents and Trademarks*